US006978638B2

(12) United States Patent
Brostow et al.

(10) Patent No.: US 6,978,638 B2
(45) Date of Patent: Dec. 27, 2005

(54) NITROGEN REJECTION FROM CONDENSED NATURAL GAS

(75) Inventors: Adam Adrian Brostow, Emmaus, PA (US); Mark Julian Roberts, Kempton, PA (US); Christopher Geoffrey Spilsbury, Haslemere (GB)

(73) Assignee: Air Products and Chemicals, Inc., Allentown, PA (US)

( * ) Notice: Subject to any disclaimer, the term of this patent is extended or adjusted under 35 U.S.C. 154(b) by 64 days.

(21) Appl. No.: 10/444,029

(22) Filed: May 22, 2003

(65) Prior Publication Data

US 2004/0231359 A1 Nov. 25, 2004

(51) Int. Cl.[7] ..... F25J 3/00
(52) U.S. Cl. ..... 62/623; 62/620; 62/927
(58) Field of Search ..... 62/613, 620, 927, 62/622

(56) References Cited

U.S. PATENT DOCUMENTS

| | | | | |
|---|---|---|---|---|
| 2,823,523 A | * | 2/1958 | Eakin et al. | 62/622 |
| 3,516,262 A | * | 6/1970 | Bernstein | 62/619 |
| 3,559,417 A | * | 2/1971 | Hoffman | 62/622 |
| 3,677,019 A | * | 7/1972 | Olszewski | 62/613 |
| 3,818,714 A | | 6/1974 | Etzbach et al. | 62/11 |
| 3,857,251 A | | 12/1974 | Alleaume | |
| 3,874,184 A | | 4/1975 | Harper et al. | 62/28 |
| 4,225,329 A | | 9/1980 | Bailey et al. | 62/24 |
| 4,411,677 A | | 10/1983 | Pervier et al. | 62/25 |
| 4,415,345 A | | 11/1983 | Swallow | 62/28 |
| 4,451,275 A | * | 5/1984 | Vines et al. | 62/622 |
| 4,455,158 A | * | 6/1984 | Vines et al. | 62/622 |
| 4,504,295 A | | 3/1985 | Davis et al. | 62/30 |
| 4,662,919 A | * | 5/1987 | Davis | 62/622 |
| 4,732,598 A | * | 3/1988 | Rowles et al. | 62/621 |
| 5,036,671 A | | 8/1991 | Nelson et al. | 62/23 |
| 5,421,165 A | * | 6/1995 | Paradowski et al. | 62/621 |
| 5,617,741 A | | 4/1997 | McNeil et al. | 62/622 |
| 5,802,871 A | | 9/1998 | Howard et al. | 62/627 |
| 5,893,274 A | | 4/1999 | Nagelvoort et al. | 62/613 |
| 6,070,429 A | | 6/2000 | Low et al. | 62/612 |

(Continued)

FOREIGN PATENT DOCUMENTS

EP 0 725 256 A 8/1996

(Continued)

OTHER PUBLICATIONS

H. Paradowski et al, *Increasing LNG Train Capacity Througt Higher MCHE Outlet Temperatures*, Thirteenth International Conference & Exhibition on Liquefied natural Gas, Seoul, Korea, May 14-17, 2001.

(Continued)

*Primary Examiner*—William C. Doerrler
(74) *Attorney, Agent, or Firm*—Willard Jones, II

(57) ABSTRACT

Method for the rejection of nitrogen from condensed natural gas which comprises (a) introducing the condensed natural gas into a distillation column at a first location therein, withdrawing a nitrogen-enriched overhead vapor stream from the distillation column, and withdrawing a purified liquefied natural gas stream from the bottom of the column; (b) introducing a cold reflux stream into the distillation column at a second location above the first location, wherein the refrigeration to provide the cold reflux stream is obtained by compressing and work expanding a refrigerant stream comprising nitrogen; and (c) either (1) cooling the purified liquefied natural gas stream or cooling the condensed natural gas stream or (2) cooling both the purified liquefied natural gas stream and the condensed natural gas stream, wherein refrigeration for (1) or (2) is obtained by compressing and work expanding the refrigerant stream comprising nitrogen. The refrigerant stream may comprise all or a portion of the nitrogen-rich vapor stream from the distillation column.

29 Claims, 8 Drawing Sheets

U.S. PATENT DOCUMENTS

| | | | | |
|---|---|---|---|---|
| 6,199,403 | B1 | 3/2001 | Cole et al. | 62/613 |
| 6,298,688 | B1 | 10/2001 | Brostow et al. | 62/613 |
| 6,308,531 | B1 | 10/2001 | Roberts et al. | 62/611 |
| 6,449,984 | B1 | 9/2002 | Paradowski | 62/613 |

FOREIGN PATENT DOCUMENTS

| | | | |
|---|---|---|---|
| EP | 0725256 | 6/1999 | F25J 3/02 |
| EP | 1092931 | 4/2001 | F25J 1/02 |
| EP | 1 258 690 A | 11/2002 | |

OTHER PUBLICATIONS

Ruhemann M: "Cryogenic Techniques in Enhanced Recovery of Oil and Gas" Indian Journal of Cryogenics, Indian Cryogenics Council, Calcutta, IN vol. 9, No. 4 1984; pp. 256-261, XP008007141 ISSN: 0379-0479; Fig. 2.

* cited by examiner

NITROGEN REJECTION FROM CONDENSED NATURAL GAS

BACKGROUND OF THE INVENTION

Raw natural gas contains primarily methane and also includes numerous minor constituents such as water, hydrogen sulfide, carbon dioxide, mercury, nitrogen, and light hydrocarbons typically having two to six carbon atoms. Some of these constituents, such as water, hydrogen sulfide, carbon dioxide, and mercury, are contaminants which are harmful to downstream steps such as natural gas processing or the production of liquefied natural gas (LNG), and these contaminants must be removed upstream of these processing steps. After these contaminants are removed, the hydrocarbons heavier than methane are condensed and recovered as natural gas liquids (NGL) and the remaining gas, which comprises primarily methane, nitrogen, and residual light hydrocarbons, is cooled and condensed to yield a final LNG product.

Because crude natural gas may contain 1–10 mole % nitrogen, removal of nitrogen is necessary in many LNG production scenarios. A nitrogen rejection unit (NRU) and/or one or more flash steps may be utilized to reject nitrogen from the LNG prior to final product storage. Nitrogen rejection requires additional refrigeration, and this refrigeration may be supplied by expansion of the feed to the nitrogen rejection system, by expansion of the recovered nitrogen-rich gas, by utilizing a portion of the refrigeration provided for liquefaction, or combinations thereof. Depending on the nitrogen rejection process, the rejected nitrogen still may contain a significant concentration of methane, and if so, this rejected nitrogen stream cannot be vented and must be sent to the plant fuel system.

In the production of LNG, liquefaction typically is carried out at elevated pressures in the range of 500 to 1000 psia, and the LNG from the liquefaction section therefore must be reduced in pressure or flashed prior to storage at near-atmospheric pressure. In this flash step, flash gas containing residual nitrogen and vaporized methane product is withdrawn for use as fuel. In order to minimize the generation flash gas, the liquefaction process typically includes a final subcooling step, which requires additional refrigeration.

In certain LNG operations, the generation of fuel gas streams in the final steps of the liquefaction process may be undesirable. This reduces available options for disposing of rejected nitrogen, since venting is possible only if the rejected nitrogen contains low concentrations of methane, for example, below about 5 mole %. Such low concentrations of methane in the reject nitrogen can be attained only by an efficient nitrogen rejection unit, and this requires sufficient refrigeration to effect the nitrogen-methane separation.

There is a need in the LNG field for improved nitrogen rejection processes which minimize methane rejection and which integrate efficiently with the LNG refrigeration system. The present invention, as described below and defined in the appended claims, addresses this need by providing process embodiments for removing nitrogen from LNG with minimum methane loss, wherein the process integrates LNG production and storage with efficient refrigeration for nitrogen rejection and final product cooling.

BRIEF SUMMARY OF THE INVENTION

One embodiment of the invention includes a method for the rejection of nitrogen from condensed natural gas which comprises (a) introducing the condensed natural gas into a distillation column at a first location therein, withdrawing a nitrogen-enriched overhead vapor stream from the distillation column, and withdrawing a purified liquefied natural gas stream from the bottom of the column; (b) introducing a cold reflux stream into the distillation column at a second location above the first location, wherein the refrigeration to provide the cold reflux stream is obtained by compressing and work expanding a refrigerant stream comprising nitrogen; and (c) either (1) cooling the purified liquefied natural gas stream or cooling the condensed natural gas stream or (2) cooling both the purified liquefied natural gas stream and the condensed natural gas stream, wherein refrigeration for (1) or (2) is obtained by compressing and work expanding the refrigerant stream comprising nitrogen. The refrigerant stream may comprise all or a portion of the nitrogen-rich vapor stream from the distillation column. The nitrogen-enriched overhead vapor stream may contain less than 5 mole % methane, and may contain less than 2 mole % methane.

The method may further comprise cooling the condensed natural gas prior to introduction into the distillation column by indirect heat exchange with a vaporizing liquid withdrawn from the bottom of the distillation column to provide a vaporized bottoms stream and a cooled condensed natural gas stream, and introducing the vaporized bottoms stream into the distillation column to provide boilup vapor therein. The pressure of the cooled condensed natural gas may be reduced by means of an expansion valve or an expander prior to the distillation column.

The cold reflux stream, refrigeration to provide the cold reflux stream, and refrigeration to cool either (i) the purified liquefied natural gas stream or the condensed natural gas stream or (ii) both the purified liquefied natural gas stream and the condensed natural gas stream may be provided by (1) combining the nitrogen-enriched overhead vapor stream from the distillation column with a work-expanded nitrogen-rich stream obtained from the nitrogen-enriched overhead vapor stream to yield a combined cold nitrogen-rich stream;

(2) warming the combined cold nitrogen-rich stream to provide by indirect heat exchange the refrigeration to provide the cold reflux stream and the refrigeration to cool either (i) the purified liquefied natural gas stream or the condensed natural gas stream or (ii) both the purified liquefied natural gas stream and the condensed natural gas stream, thereby generating a warmed nitrogen-rich stream;

(3) further warming the warmed nitrogen-rich stream by indirect heat exchange with a compressed nitrogen-rich stream, thereby providing a cooled compressed nitrogen-rich stream and a further warmed nitrogen-rich stream;

(4) withdrawing a first portion of the further warmed nitrogen-rich stream as a nitrogen reject stream and compressing a second portion of the further warmed nitrogen-rich stream to provide the compressed nitrogen-rich stream of (3);

(5) withdrawing a first portion of the cooled compressed nitrogen-rich stream and work expanding the portion of the cooled compressed nitrogen-rich stream to provide the work-expanded nitrogen-rich stream of (1); and (6) cooling a second portion of the cooled compressed nitrogen-rich stream by indirect heat exchange with the cold nitrogen-rich stream to provide a cold compressed nitrogen-rich stream and reducing the pressure of the cold compressed nitrogen-rich stream to provide the cold reflux stream.

The purified liquefied natural gas stream may be cooled by indirect heat exchange with the nitrogen-enriched overhead vapor stream from the distillation column and the cold nitrogen-rich refrigerant stream to provide a subcooled liquefied natural gas product.

Alternatively, the cold reflux stream, refrigeration to provide the cold reflux stream, and refrigeration to cool either (i) the purified liquefied natural gas stream or the condensed natural gas stream or (ii) both the purified liquefied natural gas stream and the condensed natural gas stream may be provided by (1) warming the nitrogen-enriched overhead vapor stream from the distillation column to provide by indirect heat exchange a first portion of the refrigeration to generate the cold reflux stream and to cool either (i) the purified liquefied natural gas stream or the condensed natural gas stream or (ii) both the purified liquefied natural gas stream and the condensed natural gas stream, thereby providing a warmed nitrogen-rich vapor stream;

(2) withdrawing a first portion of the warmed nitrogen-rich vapor stream as a nitrogen reject stream and compressing a second portion of the warmed nitrogen-rich vapor stream to provide a compressed nitrogen-rich stream;

(3) combining the compressed nitrogen-rich stream with a warmed work expanded nitrogen-rich stream to provide a combined nitrogen-rich stream and compressing the combined nitrogen-rich stream to provide a combined compressed nitrogen-rich stream;

(4) cooling the combined compressed nitrogen-rich stream to yield a cooled compressed nitrogen-rich stream, work expanding a first portion of the cooled compressed nitrogen-rich stream to yield a cold nitrogen-rich refrigerant stream, and warming the cold nitrogen-rich refrigerant stream to provide by indirect heat exchange a second portion of the refrigeration to generate the cold reflux stream and to cool either (i) the purified liquefied natural gas stream or the condensed natural gas stream or (ii) both the purified liquefied natural gas stream and the condensed natural gas stream, thereby providing the warmed work expanded nitrogen-rich stream; and (5) cooling a second portion of the cooled compressed nitrogen-rich stream by indirect heat exchange with the nitrogen-enriched overhead vapor stream from the distillation column and the cold nitrogen-rich refrigerant stream to provide a cold compressed nitrogen-rich stream, and reducing the pressure of the cold compressed nitrogen-rich stream to provide the cold reflux stream.

The purified liquefied natural gas stream may be subcooled by indirect heat exchange with the nitrogen-enriched overhead vapor stream from the distillation column and the cold nitrogen-rich refrigerant stream to provide a subcooled liquefied natural gas product.

The method may further comprise reducing the pressure of the cold compressed nitrogen-rich stream to provide a cold two-phase nitrogen-rich stream, separating the cold two-phase nitrogen-rich stream to yield a cold nitrogen-rich liquid stream and a cold nitrogen-rich vapor stream, reducing the pressure of the cold nitrogen-rich liquid stream to provide the cold reflux stream, and combining the cold nitrogen-rich vapor stream with the cold nitrogen-rich refrigerant stream of (4). The method also may further comprise reducing the pressure of the cold nitrogen-rich vapor stream to provide a reduced-pressure vapor stream and combining the reduced-pressure vapor stream with either the cold nitrogen-rich refrigerant stream of (4) or the nitrogen-enriched overhead vapor stream from the distillation column of (1).

If desired, a portion of the cold nitrogen-rich liquid stream may be vaporized in an intermediate condenser in the distillation column between the first and second locations therein to form a vaporized nitrogen-rich stream, and the vaporized nitrogen-rich stream is combined with the cold nitrogen-rich vapor stream.

The method may further comprise reducing the pressure of the condensed natural gas stream to form a two-phase stream, separating the two-phase stream into a methane-enriched liquid stream and a nitrogen-enriched vapor stream, cooling the methane-enriched liquid stream by indirect heat exchange with the nitrogen-enriched overhead vapor stream from the distillation column and the cold nitrogen-rich refrigerant stream to provide a subcooled condensed natural gas feed stream, further cooling the subcooled condensed natural gas feed stream by indirect heat exchange with a vaporizing liquid withdrawn from the bottom of the distillation column to provide a vaporized bottoms stream, introducing the vaporized bottoms stream into the distillation column to provide boilup vapor therein, cooling the nitrogen-enriched vapor stream by indirect heat exchange with the nitrogen-enriched overhead vapor stream from the distillation column and the cold nitrogen-rich refrigerant stream to provide a cooled natural gas feed stream, and introducing the cooled natural gas feed stream into the distillation column at a point intermediate the first and second location therein.

Optionally, the purified liquefied natural gas stream may be subcooled by indirect heat exchange with the nitrogen-enriched overhead vapor stream from the distillation column and with the cold nitrogen-rich refrigerant stream.

Following cooling of the second portion of the cooled compressed nitrogen-rich stream by indirect heat exchange with the nitrogen-enriched overhead vapor stream from the distillation column and the cold nitrogen-rich refrigerant stream and prior to reducing the pressure of the cold compressed nitrogen-rich stream to provide the cold reflux stream, the cold compressed nitrogen-rich stream may be further cooled by indirect heat exchange with a vaporizing liquid withdrawn from the bottom of the distillation column, thereby providing a vaporized bottoms stream, and introducing the vaporized bottoms stream into the distillation column to provide boilup vapor therein.

Alternatively, the cold reflux stream, refrigeration to provide the cold reflux stream, and refrigeration to cool either (i) the purified liquefied natural gas stream or the condensed natural gas stream or (ii) both the purified liquefied natural gas stream and the condensed natural gas stream may be provided by (1) warming a cold nitrogen-rich vapor stream to provide a first portion of refrigeration to provide the cold reflux stream and refrigeration to cool either (i) the purified liquefied natural gas stream or the condensed natural gas stream or (ii) both the purified liquefied natural gas stream and the condensed natural gas stream, thereby providing a warmed nitrogen-rich vapor stream;

(2) compressing the warmed nitrogen-rich vapor stream to provide a compressed nitrogen-rich stream;

(3) combining the compressed nitrogen-rich stream with a warmed work expanded nitrogen-rich stream to provide a combined nitrogen-rich stream and compressing the combined nitrogen-rich stream to provide a combined compressed nitrogen-rich stream;

(4) cooling the combined compressed nitrogen-rich stream to yield a cooled compressed nitrogen-rich stream, work expanding a first portion of the cooled compressed nitrogen-rich stream to yield a cold nitrogen-rich refrigerant stream, and warming the cold nitrogen-rich refrigerant stream to provide a second portion of refrigeration to cool either (ii) the purified liquefied natural gas stream or the condensed natural gas stream or (ii) both the purified liquefied natural gas stream and the condensed natural gas stream, thereby providing the warmed work expanded nitrogen-rich stream of (3);

(f) cooling a second portion of the cooled compressed nitrogen-rich stream by indirect heat exchange with the cold nitrogen-enriched overhead vapor stream and the cold nitrogen-rich refrigerant stream to provide a cold compressed nitrogen-rich stream, and reducing the pressure of the cold compressed nitrogen-rich stream to provide a cold nitrogen-rich refrigerant stream; and (g) partially condensing overhead vapor from the distillation column in the overhead condenser by indirect heat exchange with the cold nitrogen-rich refrigerant stream to form a two-phase overhead stream and the nitrogen-rich vapor stream of (1), separating the two-phase overhead stream into a vapor portion and a liquid portion, returning the liquid portion to the distillation column as the cold reflux stream, and withdrawing the vapor portion as a nitrogen reject stream.

Another embodiment of the invention includes a method for the rejection of nitrogen from condensed natural gas which comprises (a) introducing a condensed natural gas feed into a distillation column at a first location therein, withdrawing a nitrogen-enriched overhead vapor stream from the distillation column, and withdrawing a purified liquefied natural gas stream from the bottom of the column; and (b) introducing a cold reflux stream into the distillation column at a second location above the first location, wherein the cold reflux stream and refrigeration to provide the cold reflux stream are obtained by steps which comprise compressing all or a portion of the nitrogen-enriched overhead vapor stream to provide a compressed nitrogen-enriched stream, work expanding a portion of the compressed nitrogen-enriched stream to generate the refrigeration to provide the cold reflux stream, and cooling and reducing the pressure of another portion of the compressed nitrogen-enriched stream to provide the cold reflux stream.

The condensed natural gas feed to the distillation column may be provided by cooling condensed natural gas by indirect heat exchange with a vaporizing liquid withdrawn from the bottom of the distillation column to provide a vaporized bottoms stream, and introducing the vaporized bottoms stream into the distillation column to provide boilup vapor therein.

Alternatively, the cold reflux stream and refrigeration to provide the cold reflux stream may be provided by (a) warming the nitrogen-enriched overhead vapor stream from the distillation column to provide a first portion of refrigeration to provide the cold reflux stream, thereby providing a warmed nitrogen-rich vapor stream;

(b) withdrawing a first portion of the warmed nitrogen-rich vapor stream as a nitrogen reject stream and compressing a second portion of the warmed nitrogen-rich vapor stream to provide a compressed nitrogen-rich stream;

(c) combining the compressed nitrogen-rich stream with a warmed work expanded nitrogen-rich stream to provide a combined nitrogen-rich stream and compressing the combined nitrogen-rich stream to provide a combined compressed nitrogen-rich stream;

(d) cooling the combined compressed nitrogen-rich stream to yield a cooled compressed nitrogen-rich stream, work expanding a first portion of the cooled compressed nitrogen-rich stream to yield a cold nitrogen-rich refrigerant stream, and warming the cold nitrogen-rich refrigerant stream to provide a second portion of the refrigeration to provide the cold reflux stream, thereby providing the warmed work expanded nitrogen-rich stream; and (e) cooling a second portion of the cooled compressed nitrogen-rich stream by indirect heat exchange with the nitrogen-enriched overhead vapor stream from the distillation column and the cold nitrogen-rich refrigerant stream to provide a cold compressed nitrogen-rich stream, reducing the pressure of the cold compressed nitrogen-rich stream to provide a reduced-pressure cold nitrogen-rich stream, and introducing the reduced-pressure cold nitrogen-rich stream into the distillation column as the cold reflux stream.

The pressure of the condensed natural gas prior to the distillation column may be reduced by passing the cooled liquefied natural gas feed through a dense-fluid expander.

Another embodiment of the invention relates to a system for the rejection of nitrogen from condensed natural gas which comprises (a) a distillation column having a first location for introducing the condensed natural gas, a second location for introducing a cold reflux stream, wherein the second location is above the first location, an overhead line for withdrawing a nitrogen-enriched overhead vapor stream from the top of the column, and a line for withdrawing a purified liquefied natural gas stream from the bottom of the column;

(b) compression means for compressing a refrigerant comprising nitrogen to provide a compressed nitrogen-containing refrigerant;

(c) an expander for work expanding a first portion of the compressed nitrogen-containing refrigerant to provide a cold work-expanded refrigerant;

(d) heat exchange means for warming the cold work-expanded refrigerant and for cooling, by indirect heat exchange with the cold work-expanded refrigerant, a second portion of the compressed nitrogen-containing refrigerant and either (1) the purified liquefied natural gas stream or the condensed natural gas stream or (2) both the purified liquefied natural gas stream and the condensed natural gas stream; and (e) means for reducing the pressure of a cooled second portion of the compressed nitrogen-containing refrigerant withdrawn from the heat exchange means to provide refrigeration to the distillation column.

The system also may comprise piping means to combine the nitrogen-enriched overhead vapor stream and the cold work-expanded nitrogen-rich gas to form a cold combined nitrogen-rich stream, wherein the heat exchange means comprises one or more flow passages for warming the cold combined nitrogen-rich stream to provide a warmed combined nitrogen-rich stream. The compression means may include a single-stage compressor for compression of the warmed combined nitrogen-rich stream.

The heat exchange means may comprise a first group of flow passages for warming the nitrogen-enriched overhead vapor stream to form a warmed nitrogen-enriched overhead vapor stream and a second group of flow passages for warming the cold work-expanded refrigerant to form a warmed work-expanded refrigerant. The compression means may include a compressor having a first stage and a second stage, wherein the system includes piping means to transfer the warmed nitrogen-enriched overhead vapor stream from the heat exchange means to an inlet of the first stage of the compressor and piping means to transfer the warmed work-expanded refrigerant from the heat exchange means to an inlet of the second stage of the compressor.

Another embodiment of the invention includes a system for the rejection of nitrogen from condensed natural gas which comprises (a) a distillation column having a first location for introducing the condensed natural gas into the distillation column, a second location for introducing a cold reflux stream into the distillation column, wherein the second location is above the first location, an overhead line for withdrawing a nitrogen-enriched overhead vapor stream from the distillation column, and a line for withdrawing a purified liquefied natural gas stream from the bottom of the column;

(b) compression means for compressing all or a portion of the nitrogen-enriched overhead vapor stream to provide a compressed nitrogen-rich vapor stream;

(c) an expander for work expanding a first cooled compressed nitrogen-rich vapor stream to provide a cold work-expanded nitrogen-rich stream;

(d) heat exchange means comprising (d1) a first group of flow passages for warming the cold work-expanded nitrogen-rich stream to provide a warm work-expanded nitrogen-rich stream;

(d2 ) a second group of flow passages for warming the nitrogen-enriched overhead vapor stream from the distillation column to provide a warm nitrogen-enriched overhead vapor stream;

(d3) a third group of flow passages for cooling the compressed nitrogen-rich vapor stream by indirect heat exchange with the cold work-expanded nitrogen-rich stream and the nitrogen-enriched overhead vapor stream from the distillation column to provide the first cooled compressed nitrogen-rich vapor stream and a second cooled compressed nitrogen-rich vapor stream; and (e) means for reducing the pressure of the second cooled compressed nitrogen-rich vapor stream to provide the cold reflux stream and means for introducing the cold reflux stream into the distillation column at the second location.

This system may further comprise reboiler means for cooling the condensed natural gas prior to introduction into the distillation column by indirect heat exchange with a vaporizing stream withdrawn from the bottom of the distillation column, thereby forming a vaporized stream, and means to introduce the vaporized stream into the bottom of the distillation column to provide boilup vapor therein. The compression means may include a compressor having a first stage and a second stage, and the system may include piping means to transfer the warm nitrogen-enriched overhead vapor stream from the heat exchange means to an inlet of the first stage of the compressor and piping means to transfer the warm work-expanded nitrogen-rich stream from the heat exchange means to an inlet of the second stage of the compressor.

DETAILED DESCRIPTION OF THE INVENTION

Figure 1:
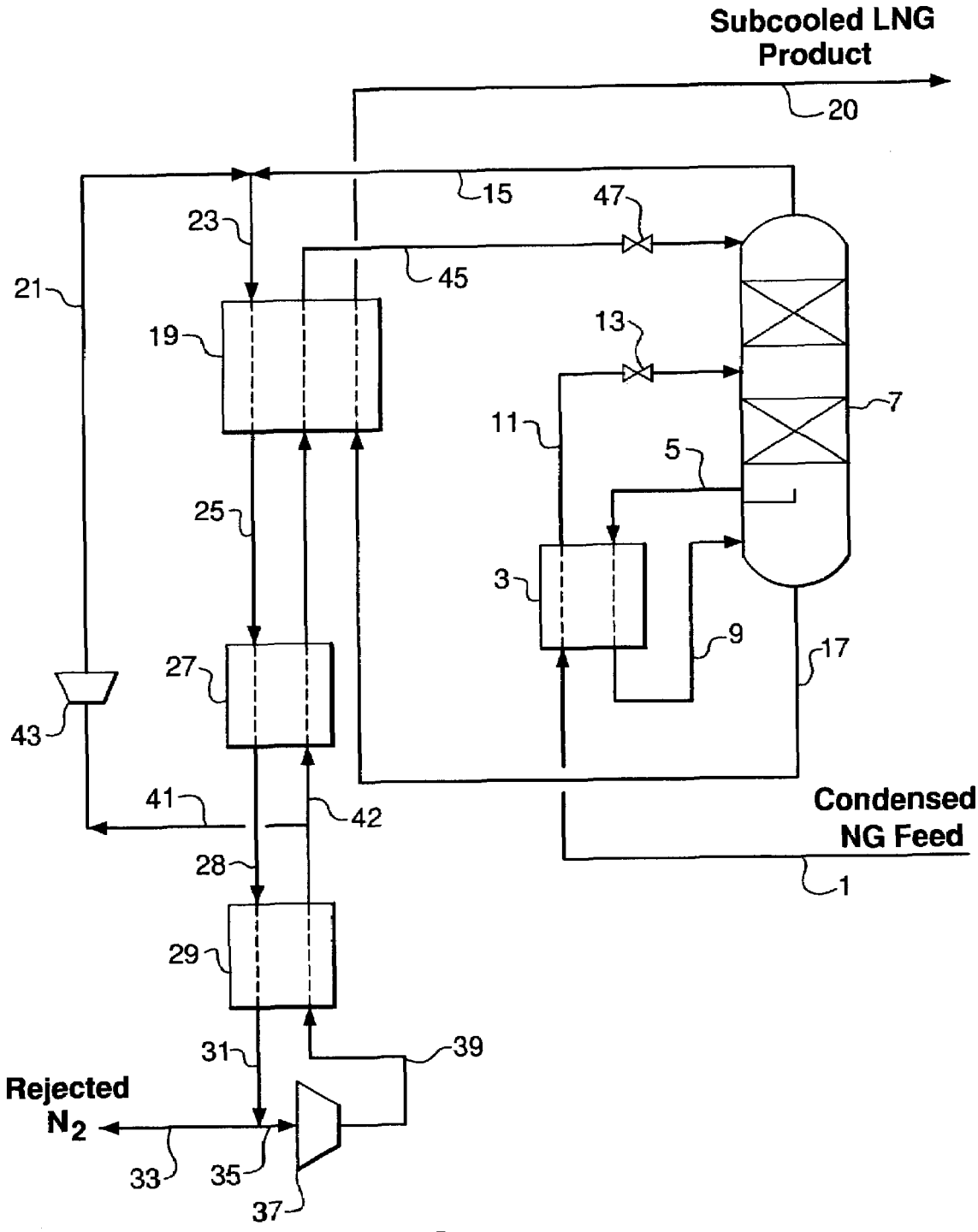
FIG. 1 is a schematic flow diagram of an embodiment of the present invention.

Embodiments of the present invention include methods to remove nitrogen from condensed natural gas with minimum methane loss using an integrated refrigeration process for nitrogen rejection to produce purified liquefied natural gas (LNG). Refrigeration to cool either (1) the purified LNG or the condensed natural gas or (2) both the purified LNG and the condensed natural gas are provided by a recycle refrigeration system utilizing the compression and work expansion of nitrogen removed from the condensed natural gas. The cold reflux stream for a nitrogen rejection distillation column also is obtained from the recycle refrigeration system.

The following definitions apply to terms used herein. Condensed natural gas is defined as natural gas which has been cooled to form a dense or condensed methane-rich phase. The condensed natural gas may exist at pressures below the critical pressure in a partially condensed, two-phase vapor-liquid state, a fully condensed saturated liquid state, or a fully condensed subcooled state. Alternatively, the condensed natural gas may exist at pressures above the critical pressure as a dense fluid having liquid-like properties.

Condensed natural gas is obtained from raw natural gas that has been treated to remove impurities which would freeze out at the low temperatures required for liquefaction or would be harmful to the liquefaction equipment. These impurities include water, mercury, and acid gases such as carbon dioxide, hydrogen sulfide, and possibly other sulfur-containing impurities. The purified raw natural gas may be further processed to remove some of the hydrocarbons heavier than methane contained therein. After these pretreatment steps, the condensed natural gas may contain nitrogen at concentrations ranging between 1 and 10 mole %.

Purified LNG is condensed natural gas from which a portion of the nitrogen originally present has been removed. Purified LNG may contain, for example, greater than 95 mole % hydrocarbons and possibly greater than 99 mole % hydrocarbons, primarily methane. Indirect heat exchange is the exchange of heat between flowing streams that are physically separate in a heat exchanger or heat exchangers.

A nitrogen reject stream or rejected nitrogen stream is a stream containing the nitrogen that has been removed from condensed natural gas. A nitrogen-rich stream is a stream that contains more than 50 mole % nitrogen, may contain more than 90 mole % nitrogen, and possibly may contain more than 99 mole % nitrogen.

A closed-loop refrigeration system is a refrigeration system comprising compression, heat exchange, and pressure reduction means in which a refrigerant is recirculated without continuous deliberate refrigerant withdrawal. A small amount of refrigerant makeup typically is required because of small leakage losses from the system. An open-loop refrigeration system is a refrigeration system comprising compression, heat exchange, and pressure reduction means in which a refrigerant is recirculated, a portion of the refrigerant is continuously withdrawn from the recirculation loop, and additional refrigerant is continuously introduced into the recirculation loop. As will be described below, the refrigerant continuously introduced into the recirculation loop may be obtained from the process stream being cooled by the refrigeration system.

A first non-limiting example of the invention is illustrated in the embodiment shown in FIG. 1. Condensed natural gas feed, which has been liquefied by any refrigeration method, enters the process via line 1. The refrigeration method for liquefaction may include, for example, methane/ethane (or ethylene)/propane cascade, single mixed refrigerant, propane pre-cooled/mixed refrigerant, dual mixed refrigerant, or any form of expander cycle refrigeration, or combinations thereof. Vapor and/or liquid expanders can also be incorporated as part of the overall refrigeration system where economically feasible. The condensed natural gas in line 1 typically is at −150 to −220° F. and 500 to 1000 psia.

The condensed natural gas optionally may be cooled in reboiler heat exchanger 3 by vaporizing liquid supplied via line 5 from nitrogen rejection distillation column 7. The vaporized stream is returned via line 9 to provide boilup vapor in distillation column 7. Other methods of cooling the condensed natural gas or providing boilup vapor to distillation column 7 may be used if desired. Cooled condensed natural gas in line 11, which optionally may be reduced in pressure across expansion valve 13, is introduced into distillation column 7 at an intermediate location therein. Alternatively, a hydraulic expansion turbine or expander may be used instead of expansion valve 13 to reduce the pressure of the cooled condensed natural gas. In other alternatives, condensed natural gas in line 1 may be reduced in pressure across an expansion valve (not shown) or a hydraulic expansion turbine (not shown) instead of or in addition to reducing the pressure of cooled condensed natural gas in line 11.

The cooled condensed natural gas is separated in distillation column 7 typically operating at 50 to 250 psia to yield nitrogen-rich overhead vapor stream in line 15 and purified LNG product in line 17. Purified LNG in line 17 may be subcooled to temperatures in the range of −230 to −260° F. in heat exchanger 19 by indirect heat exchange with a cold refrigerant (later described) and flows to LNG product storage via line 20. The pressure of the subcooled LNG product typically is reduced to near atmospheric pressure (not shown) before storage, which may provide additional nitrogen removal if desired.

The nitrogen-rich overhead vapor stream in line 15 is combined with a cold, work-expanded nitrogen-rich stream in line 21 (later described) to provide a combined cold nitrogen-rich stream in line 23. This stream is warmed in heat exchanger 19 to provide refrigeration for subcooling purified LNG in line 17 as described above. The nitrogen-rich stream passes from heat exchanger 19 via line 25 and is further warmed in heat exchangers 27 and 29 to provide refrigeration therein. A further warmed nitrogen-rich stream is withdrawn from heat exchanger 29 via line 31. A first portion of the stream in line 31 is withdrawn via line 33 and removed as a nitrogen reject stream. This reject stream typically contains 1 to 5 mole % methane, and optionally may be vented to the atmosphere instead of being sent to the plant fuel system. The second portion of the stream in line 31 flows via line 35 at a pressure typically between 100 and 400 psia to compressor 37, in which it is compressed to about 600 to 1400 psia to provide a compressed nitrogen-rich stream in line 39. This stream is cooled in heat exchanger 29 and split into a major cooled compressed nitrogen-rich stream in line 41 and a smaller cooled compressed nitrogen-rich stream in line 42.

Compressor 37 typically is a centrifugal compressor comprising one or more impellers operated in series and may include intercoolers and/or aftercoolers as known in the art. The single compressor 37 has one suction stream and one discharge stream with no additional suction streams between impellers.

Alternatively, instead of withdrawing warmed reject nitrogen via line 33, a portion equal to the reject flow in line 33 may be withdrawn from line 15, line 23, line 25, or line 28, work expanded to a lower pressure, and warmed as a separate stream (not shown) to provide additional refrigeration to the process.

The cooled compressed nitrogen-rich stream in line 41 is work expanded by expander 43 to provide the cold, work-expanded nitrogen-rich stream in line 21 described above. The cooled compressed nitrogen-rich stream in line 42 is further cooled in heat exchangers 27 and 19 to yield a subcooled liquid (if at subcritical conditions) or a cold dense fluid (if at supercritical conditions), and the resulting cold compressed nitrogen-rich stream in line 45 is reduced in pressure across expansion valve 47 and introduced into the top of nitrogen rejection distillation column 7 to provide cold reflux therein. Alternatively, pressure reduction of the stream in line 45 may be effected by work expansion. While heat exchangers 19, 27, and 29 have been shown as separate heat exchangers, these may be combined into one or two heat exchangers if desired. The compressed nitrogen-rich stream may be precooled with a refrigerant such as propane prior to cooling in heat exchanger 29 in any embodiment if the invention.

The example of FIG. 1 is an integrated process that utilizes a nitrogen expander-type recycle refrigeration system to provide refrigeration to subcool the purified LNG product stream and also to operate the distillation column which rejects nitrogen from the condensed natural gas feed stream. A portion of the compressed recycle nitrogen is not expanded but is instead liquefied and used as reflux for the nitrogen rejection column. This example is an open-loop type process; that is, the nitrogen rejected from the column with a small amount of methane, typically 1 to 5 mole % methane, is mixed with the refrigerant nitrogen. Therefore, the recycle nitrogen stream contains an equilibrium level of methane that is equal to the level of methane in the reject nitrogen stream in line 15 from the column. The nitrogen in the condensed natural gas feed stream in line 1 provides make-up nitrogen to the recycle refrigeration system to compensate for the net amount of nitrogen which is rejected via line 33. The reject nitrogen stream in line 33 typically is of sufficient purity, i.e., has a sufficiently low methane content, that it can be vented to atmosphere and need not be used as fuel.

Figure 2:
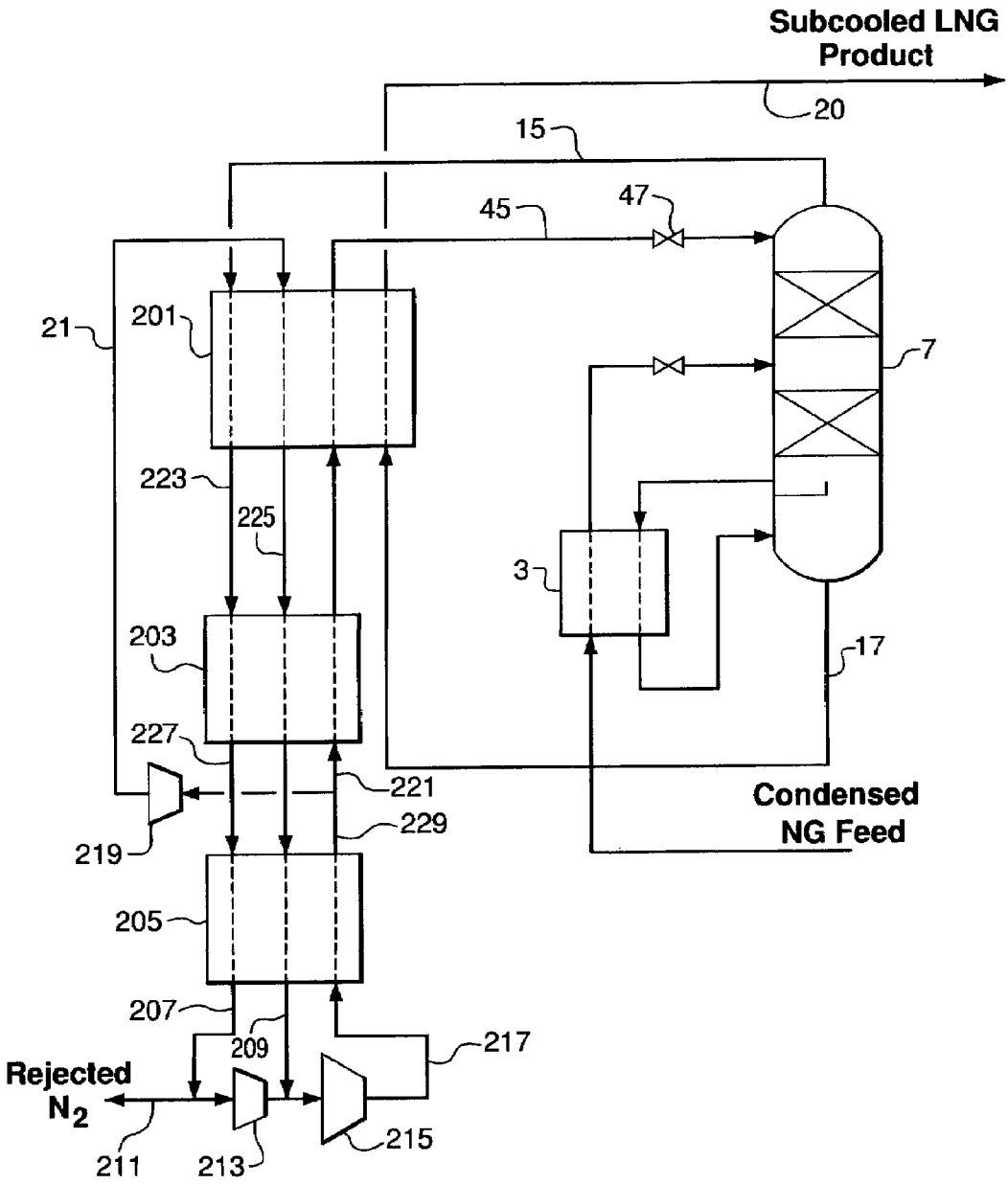
FIG. 2 is a schematic flow diagram of an alternative embodiment of the invention.

Another non-limiting example of the invention is illustrated in the embodiment shown in FIG. 2. In this embodiment, two stages of compression are used to compress the nitrogen-rich refrigerant stream. This allows distillation column 7 to operate at a pressure lower than the discharge pressure of expander 219. In the example embodiment of FIG. 2, the nitrogen-rich overhead vapor stream in line 15 is not combined with the cold, work-expanded nitrogen-rich stream in line 21 as in the embodiment of FIG. 1. Instead, these two streams are warmed separately in heat exchangers 201, 203, and 205 to yield further warmed nitrogen-rich streams at different pressures in lines 207 and 209 respectively. A portion of the low-pressure warmed nitrogen-rich stream in line 207 is discharged as a nitrogen reject stream via line 211. This reject stream typically contains 1 to 5 mole % methane, and optionally may be vented to the atmosphere instead of being sent to the plant fuel system. The remaining portion of the stream in line 207 is compressed in first stage compressor 213 to a pressure typically in the range of 100 to 400 psia and is combined with the warmed work-expanded intermediate-pressure stream in line 209. The combined stream is further compressed in second stage compressor 215 to a pressure typically in the range of 600 to 1400 psia to provide a compressed nitrogen-rich stream in line 217.

Compressors 213 and 215 operate in series with two suction streams and one discharge stream. Each compressor typically is a centrifugal compressor comprising one or more impellers operated in series and may include intercoolers and/or aftercoolers as known in the art. Combined compressors 213 and 215 may operate as a single multi-impeller machine having a common driver in which the lowest pressure suction is fed by the stream remaining after reject stream 211 is withdrawn from stream 207 and in which an intermediate pressure suction is fed by stream 209.

The compressed nitrogen-rich stream in line 217 is cooled in heat exchanger 205 and the cooled stream in line 229 is divided into two portions. A first and major portion is work expanded in expander 219 to yield the cold, work-expanded nitrogen-rich stream in line 21, and a second, smaller portion in line 221 is further cooled in heat exchangers 203 and 201 to yield a subcooled liquid (if at subcritical conditions) or a cold dense fluid (if at supercritical conditions) in line 45. The cold compressed nitrogen-rich stream in line 45 is reduced in pressure across expansion valve 47 and introduced into the top of nitrogen rejection distillation column 7 to provide cold reflux therein as described above for the embodiment of FIG. 1. Alternatively, pressure reduction of the stream in line 45 may be effected by work expansion. While heat exchangers 201, 203, and 205 have been shown as separate exchangers, these may be combined into one or two heat exchangers if desired. Purified LNG in line 17 is subcooled, typically to −230 to −260° F. in heat exchanger 201 by indirect heat exchange with the cold refrigerant streams entering via lines 15 and 21. The final subcooled LNG product flows to LNG product storage via line 20. The pressure of the subcooled LNG product typically is reduced to near atmospheric pressure (not shown) before storage.

Alternatively, instead of withdrawing warmed reject nitrogen via line 211, a portion equal to the reject flow in line 211 may be withdrawn from line 15, line 223, or line 227, and the withdrawn gas may be work expanded to near atmospheric pressure and warmed as a separate stream (not shown) to provide additional refrigeration to the process.

In a related embodiment, the nitrogen-rich overhead vapor stream in line 15 from distillation column 7 column may be warmed in a separate heat exchanger (not shown), compressed, cooled in the separate heat exchanger, and combined with the cold, work-expanded nitrogen-rich stream in line 21 for rewarming in heat exchangers 201, 203, and 205. This is somewhat less efficient than the process shown in FIG. 2 but may be useful in the retrofit or expansion of an existing plant refrigeration system.

Other features of the embodiment of FIG. 2 not discussed above are similar to the corresponding features in the embodiment of FIG. 1.

Figure 3:
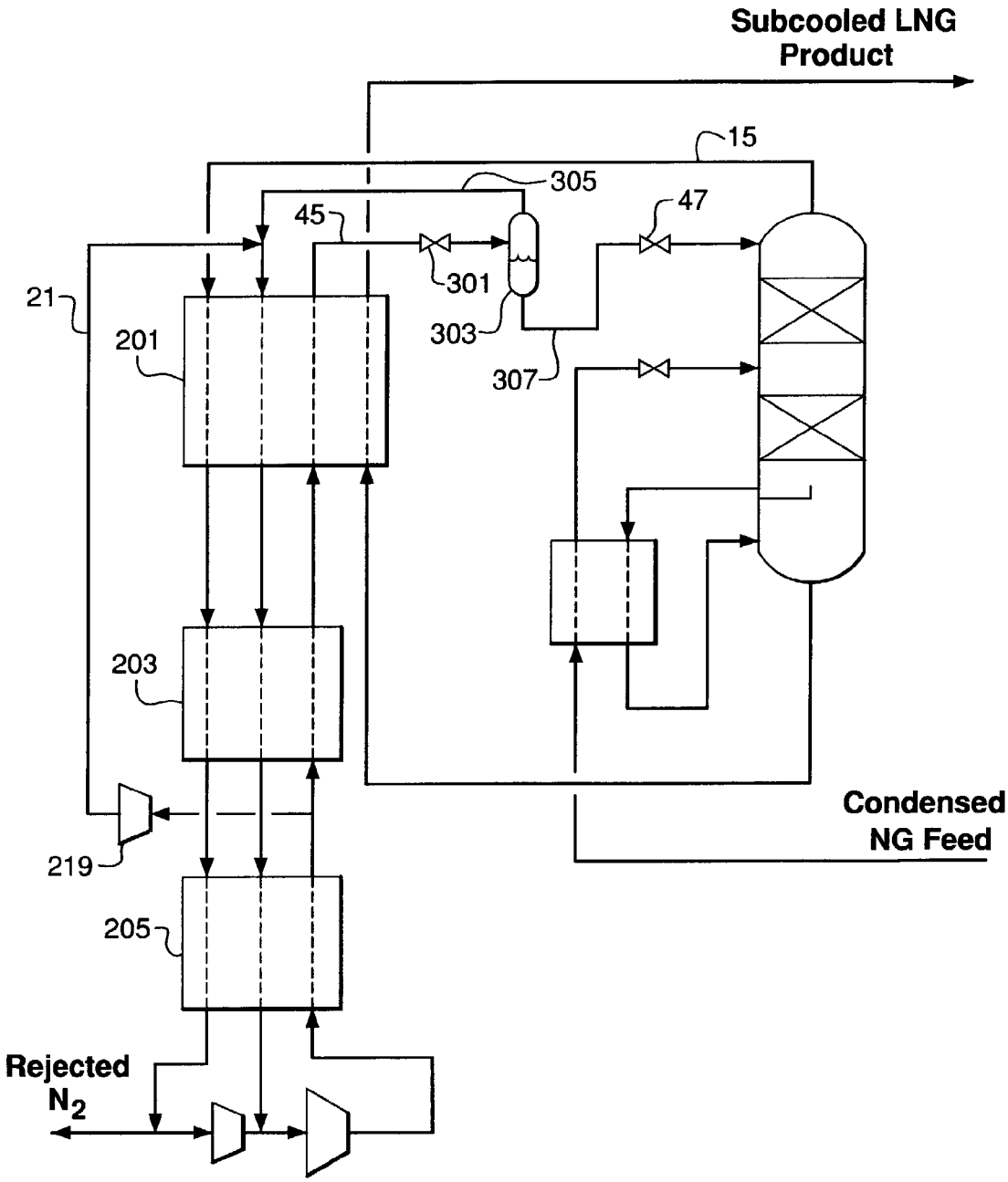
FIG. 3 is a first modification of the embodiment illustrated in the schematic flow diagram of FIG. 2.

An additional non-limiting example of the invention is illustrated in the embodiment shown in FIG. 3. In this embodiment, which is a modification of the embodiment of FIG. 2, the cold compressed nitrogen-rich stream in line 45 is reduced in pressure across expansion valve 301, introduced into separator vessel 303, and separated into a vapor stream in line 305 and a liquid stream in line 307. The vapor in line 305 is combined with the cold, work-expanded nitrogen-rich stream in line 21 for rewarming in heat exchangers 201, 203, and 205. The liquid in line 307 is further reduced in pressure across expansion valve 47 and introduced into the top of nitrogen rejection distillation column 7 to provide cold reflux therein as described above for the embodiment of FIG. 2.

Alternatively, separator vessel 303 may be operated at a lower pressure than the discharge of expander 219 and the cold, work-expanded nitrogen-rich stream in line 21 and the vapor in line 305 may warmed separately in additional passages of heat exchangers 201, 203, and 205. In this alternative, the vapor in line 305 may be work expanded and, for example, combined with the nitrogen-rich overhead vapor stream in line 15 prior to warming in heat exchangers 201, 203, and 205.

In another alternative, separator vessel 303 can be operated at a higher pressure than the discharge of expander 219 and the cold, work-expanded nitrogen-rich stream in line 21. The vapor in line 305 may be work expanded and combined with the cold, work-expanded nitrogen-rich stream in line 21 or with the nitrogen-rich overhead vapor stream in line 15 prior to warming in heat exchangers 201, 203, and 205.

Other features of the embodiment of FIG. 3 not discussed above are similar to the corresponding features in the embodiment of FIG. 2.

Figure 4:
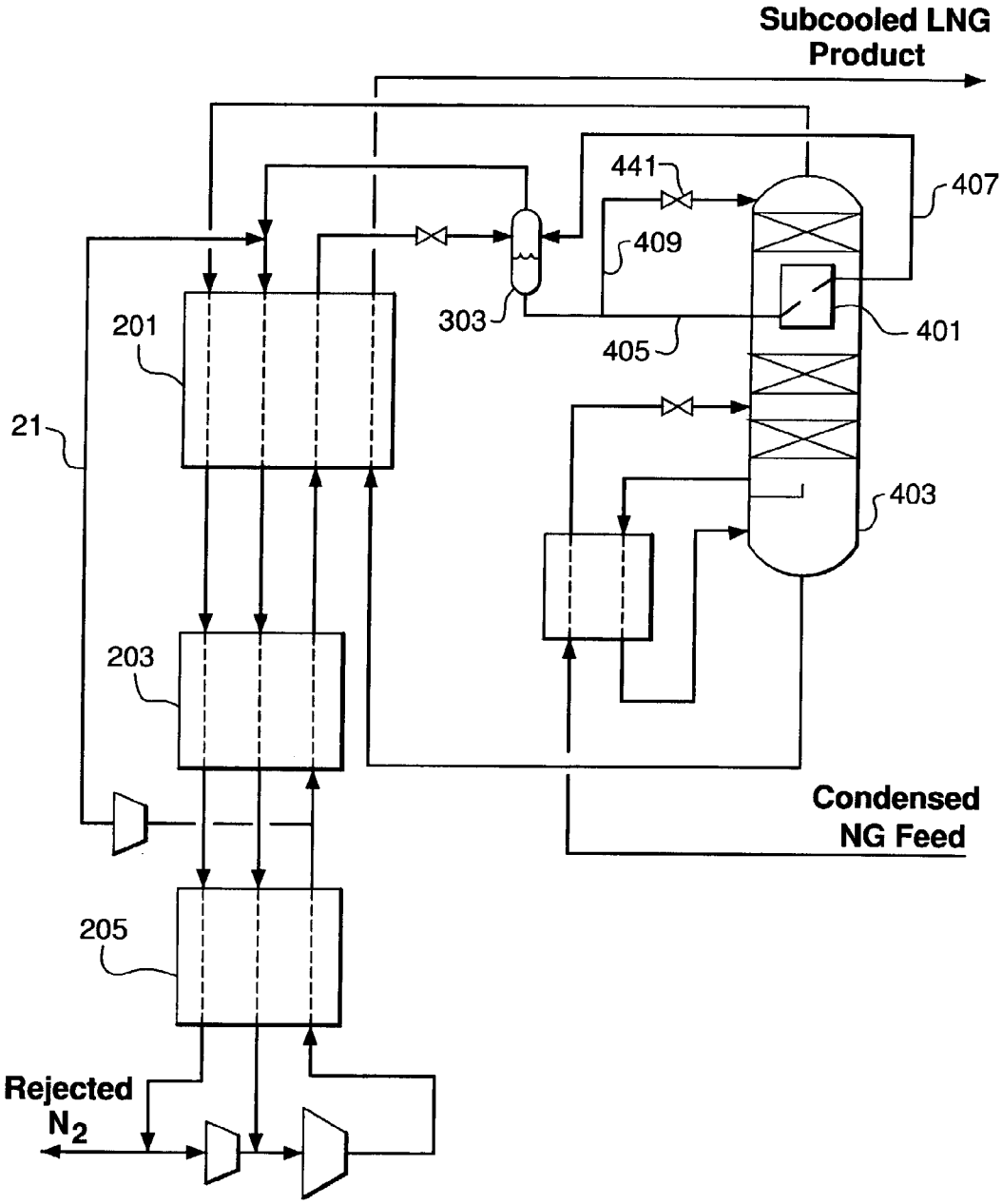
FIG. 4 is a second modification of the embodiment illustrated in the schematic flow diagram of FIG. 2.

Another non-limiting example of the invention is illustrated in the embodiment shown in FIG. 4. In this embodiment, which is a modification of the embodiment of FIG. 3, a portion of the liquid from separator vessel 303 is withdrawn via line 405 and vaporized in intermediate condenser 401 in nitrogen rejection distillation column 403, and the resulting vapor is returned via line 407 to separator vessel 303. The remaining portion of the liquid from separator vessel 303 flows via line 409, is reduced in pressure across expansion valve 411, and the reduced-pressure stream is introduced into distillation column 403 as reflux. The use of intermediate condenser 401 reduces the amount of reflux required to the top of the column, thus increasing the reversibility and efficiency of the fractionation process. The vaporized liquid in line 407 from the intermediate condenser optionally may be work expanded to a lower pressure, such as the column pressure, warmed in the heat exchangers 201, 203, and 205, and compressed for recycle. Other features of the embodiment of FIG. 4 not discussed here are similar to the corresponding features in the embodiment of FIG. 3.

Figure 5:
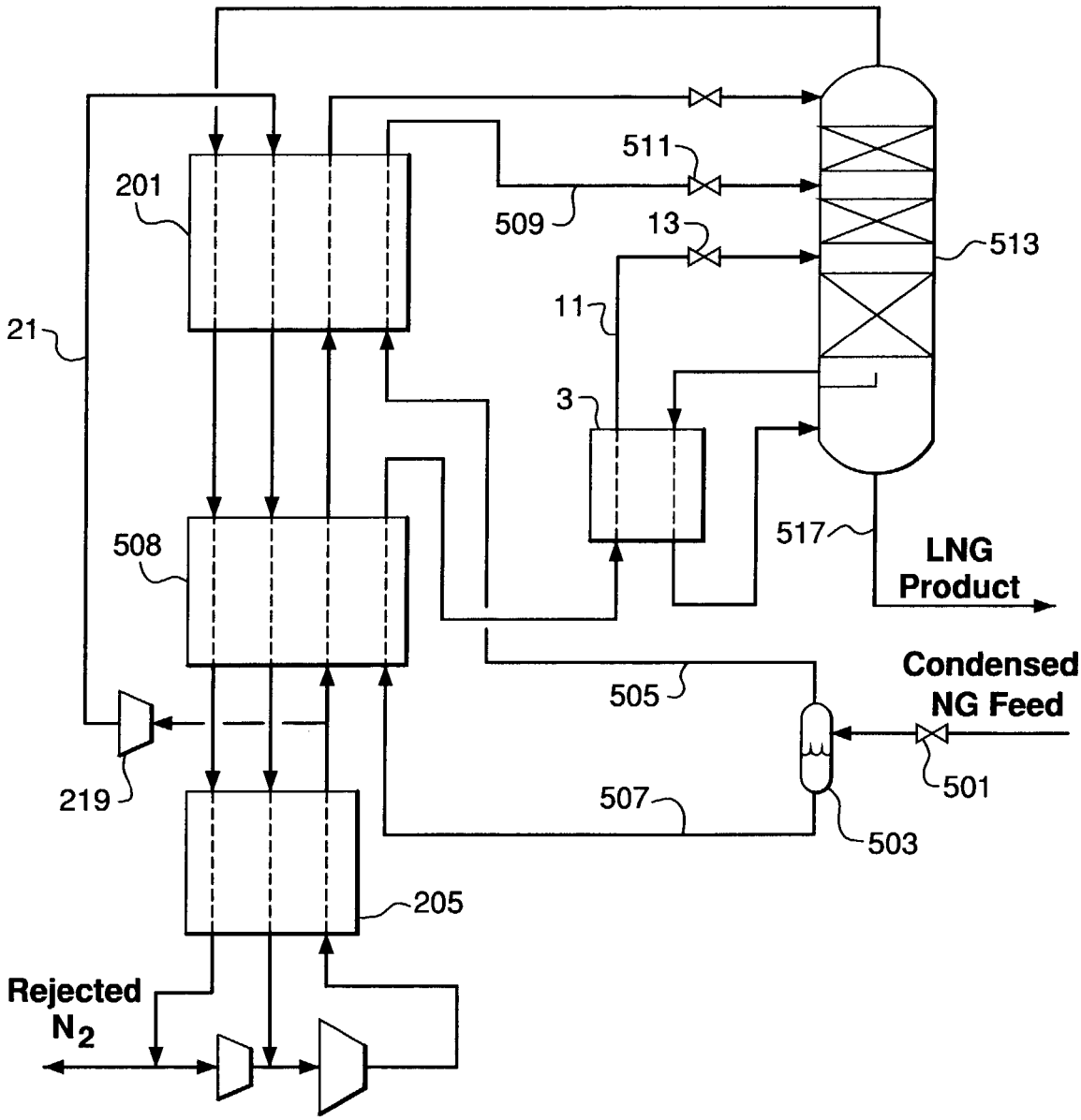
FIG. 5 is a third modification of the embodiment illustrated in the schematic flow diagram of FIG. 2.

An additional non-limiting example of the invention is illustrated in the embodiment shown in FIG. 5. In this embodiment, which is a modification of the embodiment of FIG. 2, the condensed natural gas feed is reduced in pressure across expansion valve 501 and the resulting two-phase stream is separated in separator vessel 503 into a nitrogen-enriched vapor in line 505 and a methane-enriched liquid in line 507. The vapor in line 505 is cooled and partially or fully condensed in heat exchanger 201 and the cooled stream in line 509 is optionally reduced in pressure across expansion valve 511 and introduced as impure reflux at an intermediate point in distillation column 513.

The liquid in line 507 is subcooled in heat exchanger 508 and/or reboiler heat exchanger 3, and the liquid in line 11 is optionally reduced in pressure across expansion valve 13 and introduced at a lower intermediate point in distillation column 513. When the liquid in line 507 is subcooled in heat exchanger 508 and/or reboiler heat exchanger 3, distillation column 513 may be operated at a pressure close to the LNG product storage pressure, and in this case subcooling of the purified LNG product withdrawn from distillation column 513 via line 517 may not be required.

Optionally, distillation column 513 may be operated at a higher pressure and the purified LNG product from the bottom of the column may be subcooled in heat exchanger 201. The recycle refrigeration system then would provide refrigeration to subcool the condensed natural gas feed to the column as described above and to subcool the purified LNG product from the column.

Other features of the embodiments shown in FIG. 5 not discussed above are similar to the corresponding features in the embodiment of FIG. 2.

Figure 6:
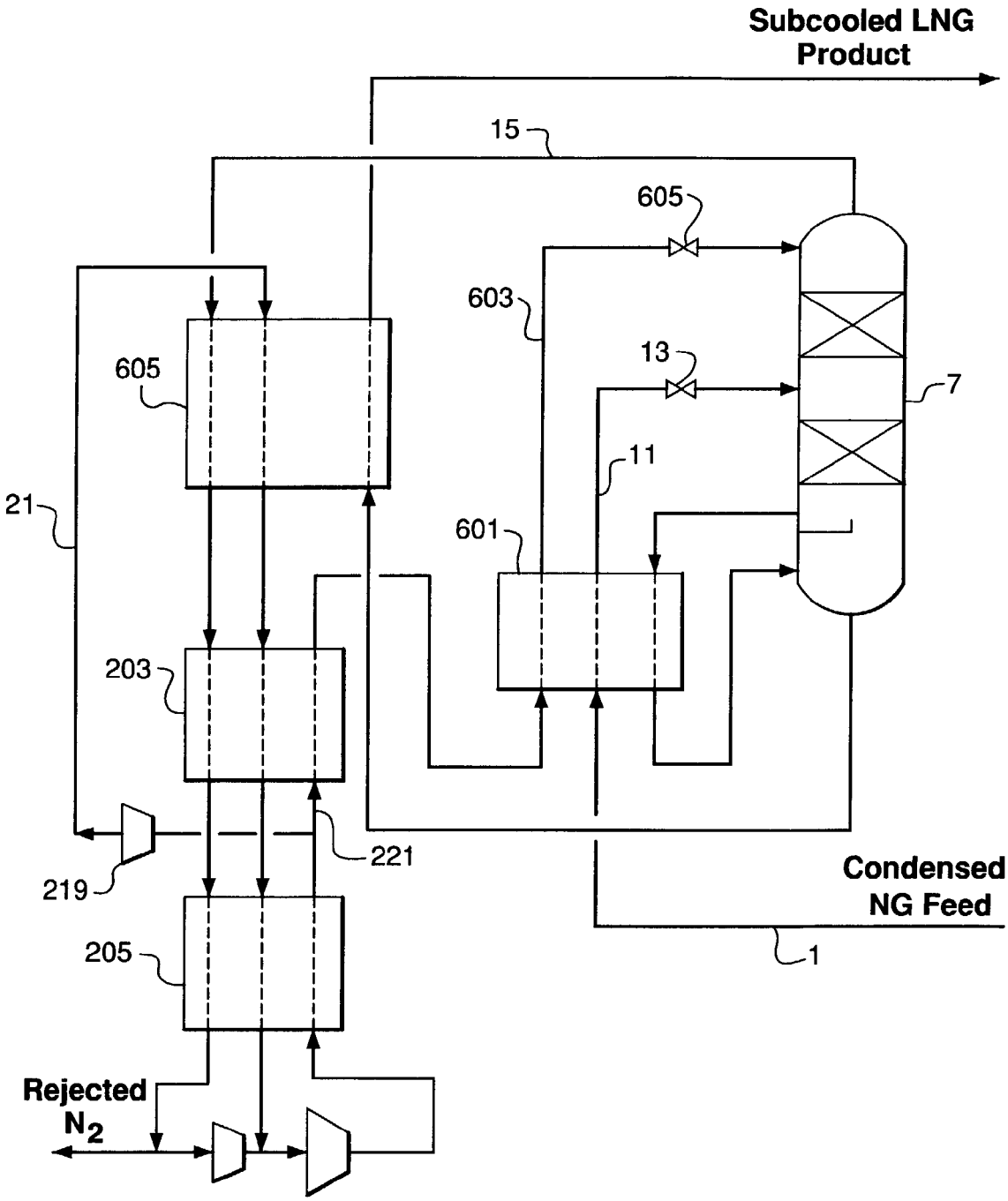
FIG. 6 is a fourth modification of the embodiment illustrated in the schematic flow diagram of FIG. 2.

Another non-limiting example of the invention is illustrated in the embodiment shown in FIG. 6, which is a modification of the embodiment of FIG. 2. In FIG. 6, reflux and refrigeration to nitrogen rejection distillation column 7 are provided by cooling the second portion of the compressed nitrogen-rich stream in line 221 in heat exchanger 203 and in modified reboiler heat exchanger 601 to yield a partially or fully condensed recycle stream in line 603. This stream is reduced in pressure across expansion valve 605 and introduced into distillation column 7 as reflux.

The discharge stream in line 219 from expander 219 generally is at an intermediate pressure level and is warmed in heat exchangers 605, 203, and 205 separately from the warming of the lower-pressure nitrogen-rich overhead vapor stream in line 15. The condensed natural gas feed in line 1 is subcooled in reboiler heat exchanger 601 and optionally reduced in pressure across expansion valve 13 or in a dense-phase expander (not shown) that may have a two-phase discharge.

The condensed natural gas feed in line 1 and the distillation column reflux stream in line 603 may optionally be cooled in separate reboilers, one a side reboiler and the other a bottom reboiler (not shown). This would provide boilup vapor at two different temperature levels by heating two different liquid streams originating from distillation column 7 at locations separated by distillation stages. Alternately, either the condensed natural gas feed in line 1 or the reflux stream in line 603 could be used in both reboilers. The reflux stream for the distillation column could optionally be obtained from an intermediate pressure level, such as from the discharge of the expander in line 21. This intermediate pressure reflux stream could be condensed in the column reboiler.

Other features of the embodiments shown in FIG. 6 and not discussed above are similar to the corresponding features in the embodiment of FIG. 2.

Figure 7:
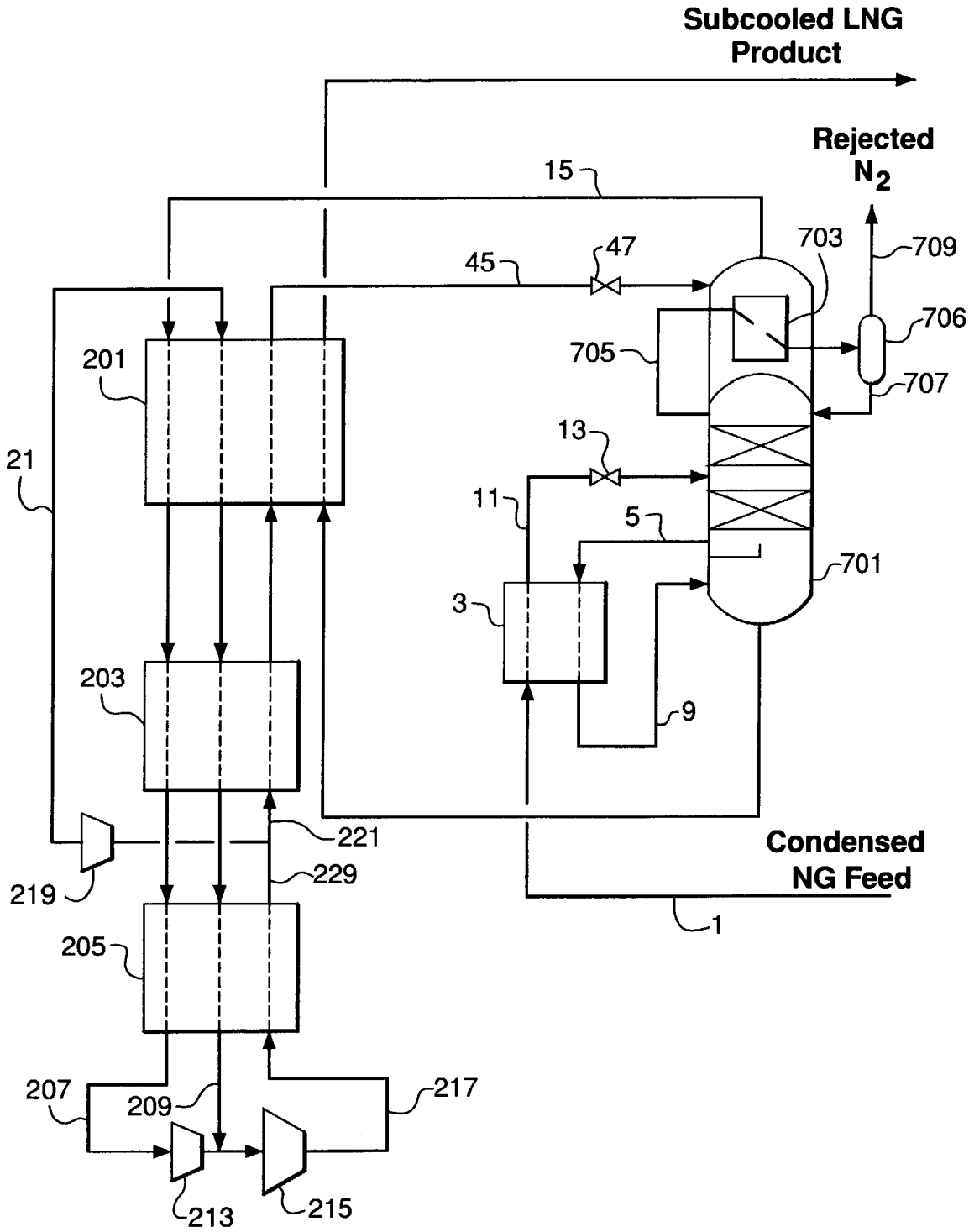
FIG. 7 is a fifth modification of the embodiment illustrated in the schematic flow diagram of FIG. 2.

A further non-limiting example of the invention is illustrated in the embodiment shown in FIG. 7, which is another modification of the embodiment of FIG. 2. In the embodiment of FIG. 7, distillation column 701 utilizes indirect overhead condenser 703 that is refrigerated by vaporizing cold compressed nitrogen-rich fluid provided via line 45 and expansion valve 47. Nitrogen-rich vapor from distillation column 701 flows via line 705 and is partially condensed in overhead condenser 703. The partially condensed stream is separated in separator 706 into a liquid stream in line 707 and a vapor stream in line 709. The liquid stream is returned via line 707 as reflux to the column and the vapor stream is withdrawn via line 709 as rejected nitrogen. This stream optionally may be vented when the methane content is below about 5 mole %; if desired, this nitrogen reject stream may be warmed in heat exchangers 201, 203, and 205 before venting.

Condensed natural gas feed, which has been liquefied by any refrigeration method, enters the process via line 1. The refrigeration method for liquefaction may include, for example, methane/ethane (or ethylene)/propane cascade, single mixed refrigerant, propane pre-cooled/mixed refrigerant, dual mixed refrigerant, or any form of expander cycle refrigeration, or combinations thereof. Vapor and/or liquid expanders also can be incorporated as part of the overall refrigeration system where economically feasible. The condensed natural gas in line 1 typically is at −150 to −220° F. and 500 to 1000 psia.

The condensed natural gas feed may be cooled in reboiler heat exchanger 3 by vaporizing liquid supplied via line 5 from nitrogen rejection distillation column 701. The vaporized stream is returned via line 9 to provide boilup vapor in distillation column 701. Other methods of cooling the condensed natural gas or providing boilup vapor to distillation column 701 may be used if desired. Cooled condensed natural gas in line 11, which optionally may be reduced in pressure across expansion valve 13, is introduced into distillation column 701 at an intermediate location therein. Alternatively, a hydraulic expansion turbine or dense-phase expander may be used instead of expansion valve 13 to reduce the pressure of the cooled condensed natural gas. In other alternatives, condensed natural gas in line 1 may be reduced in pressure across an expansion valve (not shown) or a hydraulic expansion turbine (not shown) instead of or in addition to reducing the pressure of cooled condensed natural gas in line 11.

The refrigeration for distillation column 701 is provided by a closed-loop refrigeration system which is a modification of the open-loop refrigeration system of FIG. 2. In the embodiment of FIG. 7, the vaporized low-pressure nitrogen-rich refrigerant stream in line 15 is warmed in heat exchangers 201, 203, and 205, and the final warmed stream in line 207 is compressed in first compressor stage 213 typically to 100 to 400 psia, combined with the warmed expanded intermediate-pressure nitrogen-rich stream in line 209, and compressed in second compressor stage 215 to about 600 to 1400 psia. In contrast with the embodiment of FIG. 2, no reject nitrogen stream is withdrawn from the nitrogen-rich refrigerant stream in line 207. The compressed stream in line 217 is cooled in heat exchanger 205 and a first portion of the cooled stream in line 229 is work expanded in expander 219 to provide a cold, work-expanded nitrogen-rich stream in line 21. The remaining portion of the stream via line 221 is cooled in heat exchangers 203 and 201 to provide the cold compressed nitrogen-rich fluid in line 45.

The nitrogen-rich refrigerant used in the closed-loop refrigeration system described above may be obtained from the rejected nitrogen stream in line 709, in which case the refrigerant will contain about 90 to 99 mole % nitrogen, the remainder being methane. Alternatively, nitrogen above 99 mole % purity may be used for the refrigerant and in this case could be obtained from an external source.

Alternatively, the reject nitrogen stream in line 709 from the outlet of the overhead condenser 703 may be combined with the vaporized nitrogen-rich refrigerant stream in line 15 and warmed in heat exchangers 201, 203, and 205 The net rejected nitrogen would be withdrawn from the combined warmed low-pressure stream in line 207 and the remainder sent to first stage compressor 213 for recycle. In this alternative, the refrigeration system would become an open-loop type of system similar to that in the embodiment of FIG. 2, but would utilize the indirect overhead reflux condenser instead of direct reflux addition from the refrigeration system.

Optionally, a liquid nitrogen-rich stream at an intermediate pressure could be used in the closed-loop refrigeration system to provide refrigeration for the indirect overhead condenser 703. The vaporized nitrogen-rich refrigerant stream in line 15, for example, might be combined with the intermediate pressure work-expanded nitrogen-rich stream in line 21 for warming in heat exchangers 201, 203 and 205 to eliminate the first compressor stage 213. This would provide a closed-loop refrigeration system which is a modification of the open-loop refrigeration system of FIG. 1. The reject nitrogen stream in line 709 from the outlet of the overhead condenser 703 could also be warmed separately in the heat exchangers 201, 203 and 205 to recover refrigeration prior to venting.

Figure 8:
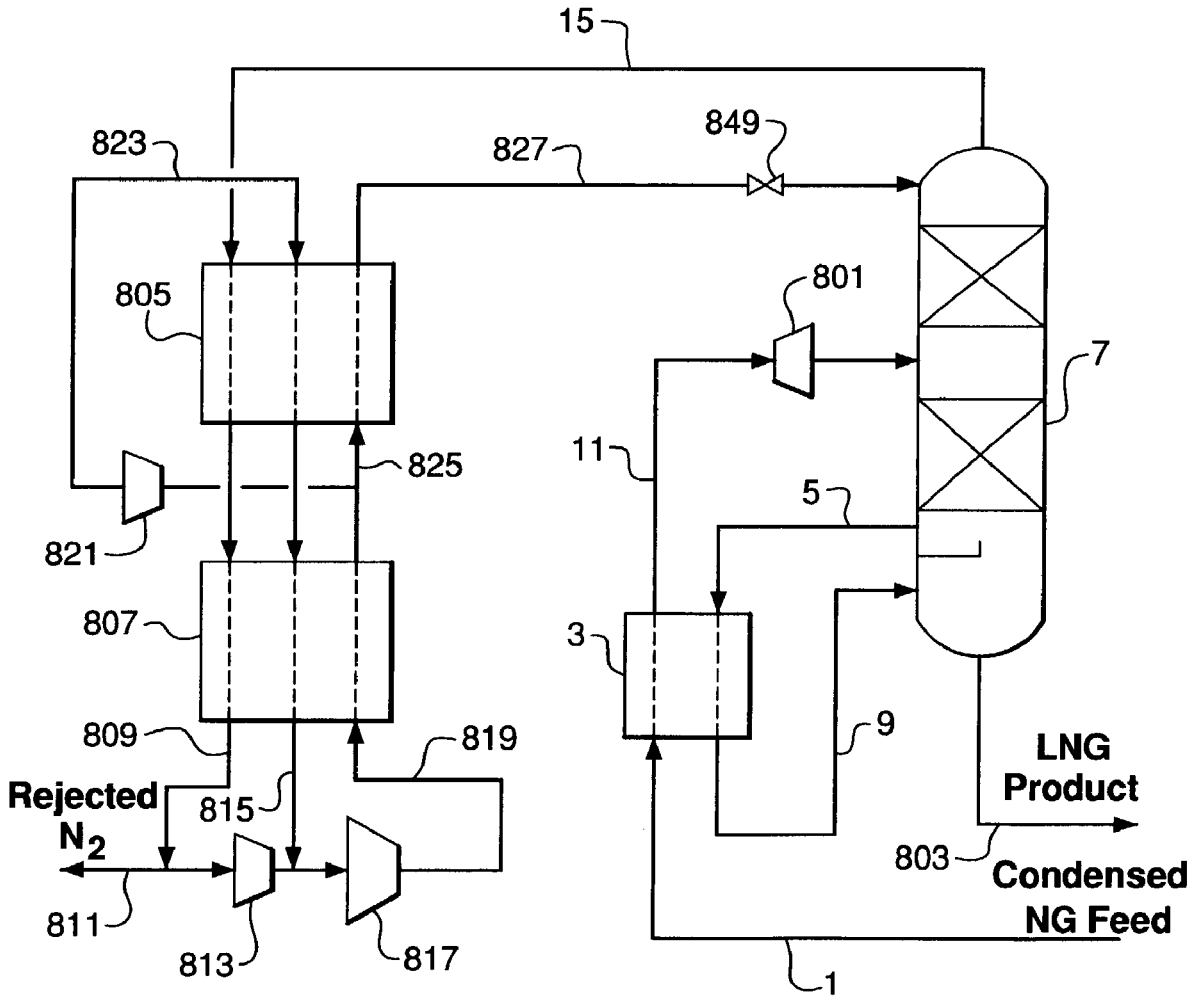
FIG. 8 is a schematic flow diagram of another alternative embodiment of the present invention.

A final non-limiting example of the invention is illustrated in the alternative embodiment shown in FIG. 8. Condensed natural gas feed, which has been liquefied by any appropriate refrigeration method, enters the process via line 1. The condensed natural gas is cooled in reboiler heat exchanger 3 by vaporizing liquid supplied via line 5 from nitrogen rejection distillation column 7 and the vaporized stream is returned via line 9 to provide boilup vapor in distillation column 7. Cooled condensed natural gas in line 11, which may be reduced in pressure across hydraulic expansion turbine or expander 801, is introduced into distillation column 7 at an intermediate location therein. Alternatively, an expansion valve may be used instead of hydraulic expansion turbine 801 to reduce the pressure of the cooled condensed natural gas. In other alternatives, condensed natural gas in line 1 may be reduced in pressure across an expansion valve (not shown) or a hydraulic expansion turbine (not shown) instead of or in addition to reducing the pressure of cooled condensed natural gas in line 11.

The cooled condensed natural gas is separated in distillation column 7 operating at a pressure close to the LNG product storage pressure, i.e., 15 to 25 psia, to yield a nitrogen-rich overhead vapor stream in line 15 and purified LNG product in line 803. Purified LNG in line 803 typically requires no subcooling and may be sent directly to LNG product storage.

The low-pressure nitrogen-rich overhead vapor stream in line 15 is warmed in heat exchangers 805 and 807 to yield further warmed nitrogen-rich stream in line 809. A portion of the warmed nitrogen-rich stream in line 809 is discharged as a nitrogen reject stream via line 811. This reject stream typically contains 1 to 5 mole % methane, and optionally may be vented to the atmosphere instead of being sent to the plant fuel system. The remaining portion of the stream in line 809 is compressed in first stage compressor 813 typically to 100 to 400 psia and then is combined with a warmed work-expanded intermediate-pressure stream in line 815. The combined stream is further compressed in second stage compressor 817 to a pressure of about 600 to 1400 psia to provide a compressed nitrogen-rich stream in line in line 819.

The compressed nitrogen-rich stream in line in line 819 is cooled in heat exchanger 807 and divided into two portions. The first and major portion is work expanded in expander 821 to yield a cold, work-expanded nitrogen-rich stream in line 823, and the second, smaller portion in line 825 is further cooled in heat exchanger 805 to yield a subcooled liquid (if at subcritical conditions) or a cold dense fluid (if at supercritical conditions) in line 827. The cold compressed nitrogen-rich stream in line 827 is reduced in pressure across expansion valve 849 and introduced into the top of distillation column 7 to provide cold reflux therein. Alternatively, pressure reduction of the stream in line 827 may be effected by work expansion. While heat exchangers 805 and 807 have been shown as separate exchangers, these may be combined into a single exchanger if desired.

In any of the above embodiments, pressure reduction of process streams may be effected by either throttling valves or expanders; the expanders may be rotating-vane expanders (i.e., turbines) or reciprocating expansion engines. The expansion work generated by the expanders may be utilized to drive other rotating equipment such as compressors. Pressure reduction of liquid or dense fluid streams may be effected by expanders typically known as hydraulic turbines or dense fluid expanders.

EXAMPLE

An embodiment of the invention as described with reference to FIG. 1 may be illustrated by the following non-limiting Example. A condensed natural gas feed stream at a flow rate of 100 lbmoles per hour containing (in mole %) 4.0% nitrogen, 88.0% methane, 5.0% ethane and 3.0% propane and heavier hydrocarbons at −165° F. and 741 psia is provided via line 1 and is cooled to −190° F. in the reboiler heat exchanger 3. The cooled LNG feed stream in line 11 from the reboiler is flashed across expansion valve 13 to 144 psia and introduced at an intermediate location into distillation column 7. A purified LNG product stream is withdrawn via line 17 at a flow rate of 96.94 lbmoles per hour containing (in mole %) 1.00% nitrogen, 90.75% methane, 5.16% ethane and 3.09% propane and heavier hydrocarbons at −190° F. and 147 psia. This LNG product stream is subcooled to −235° F. in heat exchanger 19 and sent to storage via line 20.

A nitrogen-rich overhead vapor stream is withdrawn from distillation column 7 via line 15 at a flow rate of 34.48 lbmoles per hour and contains 99.00 mole % nitrogen and 1.00 mole % methane at −272° F. and 141 psia. This stream is combined with a cold, work-expanded nitrogen-rich stream in line 21 from turboexpander 43 to provide a combined cold nitrogen-rich stream in line 23. The combined stream is warmed in heat exchangers 19, 27, and 29 to provide refrigeration for subcooling purified LNG in line 17 and for cooling the compressed nitrogen-rich stream in line 42, thereby yielding a warmed, low pressure nitrogen stream in line 31.

The low pressure nitrogen-rich stream in line 31, now at 97° F. and 131 psia and containing 99.00 mole % nitrogen and 1.00 mole % methane, is divided into a reject stream in line 33 having a flow rate of 3.06 lbmoles per hour and a main process stream at a flow rate of 135.49 lbmoles per hour in line 35. This main process stream is compressed to 1095 psia in compressor 37, and the resulting high pressure nitrogen-rich stream in line 39 at 100° F. is cooled to −123° F. in heat exchanger 29. A major portion of the cooled stream from heat exchanger 29 is withdrawn via line 41 at a flow rate of 104.07 lbmoles per hour and work expanded in turboexpander 43. The remainder of the cooled stream from heat exchanger 29 at a flow rate of 31.42 lbmoles per hour flows via line 42 through heat exchangers 27 and 19, where it is cooled to form a dense cold supercritical fluid at −235° F. This cold fluid flows via line 45, is flashed to 141 psia across expansion valve 47, and is introduced into the top of the distillation column 7 as reflux.

The nitrogen-rich overhead vapor stream withdrawn from distillation column 7 via line 15 is combined with the cold, work-expanded nitrogen-rich stream from turboexpander 43 in line 21 at −270° F. and 141 psia to provide a combined cold nitrogen-rich stream in line 23 at 138.55 lbmoles per hour. This combined stream then is warmed to −162° F. in heat exchangers 19 and 27 to provide refrigeration to subcool the purified LNG product stream in line 17 and to condense and subcool the stream in line 42 as described above. The combined low-pressure nitrogen stream is further warmed to 97° F. in heat exchanger 29 to cool the compressed high pressure nitrogen-rich stream in line 39.

The process of this Example rejects about 76% of the nitrogen in the condensed natural gas feed to distillation column 7 column to provide a purified LNG product stream in line 20 containing 1.00 mole % nitrogen, which is sufficient to meet product LNG specifications in most cases. If a lower nitrogen content is required in the purified LNG product, additional reboil and reflux can be provided to distillation column 7 to accommodate a higher level of nitrogen rejection. The subcooled LNG product stream in line 20 typically is reduced to a low pressure, e.g., 15 to 17 psia, prior to storage. If a higher nitrogen content is permitted in the LNG product, the reboil and reflux flows to distillation column 7 can be reduced to provide a lower level of nitrogen rejection.

This example also provides a nitrogen-rich reject stream via line 33 which contains only 1.00 mole % methane. Higher or lower levels of methane in the reject stream can be produced by appropriate adjustments to the reboil and reflux flow rates in distillation column 7. The nitrogen-rich reject stream has a sufficiently low methane concentration that it may be vented to the atmosphere and need not be used as fuel.

What is claimed is:

1. A method for the rejection of nitrogen from condensed natural gas which comprises (a) introducing the condensed natural gas into a distillation column at a first location therein, withdrawing a nitrogen-enriched overhead vapor stream from the distillation column, and withdrawing a purified liquefied natural gas stream from the bottom of the column;

(b) introducing a cold reflux stream into the distillation column at a second location above the first location, wherein the refrigeration to provide the cold reflux stream is obtained by compressing and work expanding a refrigerant stream comprising nitrogen; and (c) either (1) cooling the purified liquefied natural gas stream or cooling the condensed natural gas stream or (2) cooling both the purified liquefied natural gas stream and the condensed natural gas stream, wherein refrigeration for (1) or (2) is obtained by compressing and work expanding the refrigerant stream comprising nitrogen.

2. The method of claim 1 wherein the refrigerant stream comprises all or a portion of the nitrogen-rich vapor stream from the distillation column.

3. The method of claim 1 wherein the nitrogen-enriched overhead vapor stream contains less than 5 mole % methane.

4. The method of claim 3 wherein the nitrogen-enriched overhead vapor stream contains less than 2 mole % methane.

5. The method of claim 1 which further comprises cooling the condensed natural gas prior to introduction into the distillation column by indirect heat exchange with a vaporizing liquid withdrawn from the bottom of the distillation column to provide a vaporized bottoms stream and a cooled condensed natural gas stream, and introducing the vaporized bottoms stream into the distillation column to provide boilup vapor therein.

6. The method of claim 1 which further comprises reducing the pressure of the cooled condensed natural gas by means of an expansion valve or an expander prior to the distillation column.

7. The method of claim 1 wherein the cold reflux stream, refrigeration to provide the cold reflux stream, and refrigeration to cool either (i) the purified liquefied natural gas stream or the condensed natural gas stream or (ii) both the purified liquefied natural gas stream and the condensed natural gas stream are provided by (1) combining the nitrogen-enriched overhead vapor stream from the distillation column with a work-expanded nitrogen-rich stream obtained from the nitrogen-enriched overhead vapor stream to yield a combined cold nitrogen-rich stream;

(2) warming the combined cold nitrogen-rich stream to provide by indirect heat exchange the refrigeration to provide the cold reflux stream and the refrigeration to cool either (i) the purified liquefied natural gas stream or the condensed natural gas stream or (ii) both the purified liquefied natural gas stream and the condensed natural gas stream, thereby generating a warmed nitrogen-rich stream;

(3) further warming the warmed nitrogen-rich stream by indirect heat exchange with a compressed nitrogen-rich stream, thereby providing a cooled compressed nitrogen-rich stream and a further warmed nitrogen-rich stream;

(4) withdrawing a first portion of the further warmed nitrogen-rich stream as a nitrogen reject stream and compressing a second portion of the further warmed nitrogen-rich stream to provide the compressed nitrogen-rich stream of (3);

(5) withdrawing a first portion of the cooled compressed nitrogen-rich stream and work expanding the portion of the cooled compressed nitrogen-rich stream to provide the work-expanded nitrogen-rich stream of (1); and (6) cooling a second portion of the cooled compressed nitrogen-rich stream by indirect heat exchange with the cold nitrogen-rich stream to provide a cold compressed nitrogen-rich stream and reducing the pressure of the cold compressed nitrogen-rich stream to provide the cold reflux stream.

8. The method of claim 7 wherein the purified liquefied natural gas stream is cooled by indirect heat exchange with the nitrogen-enriched overhead vapor stream from the distillation column and the cold nitrogen-rich refrigerant stream to provide a subcooled liquefied natural gas product.

9. The method of claim 1 wherein the cold reflux stream, refrigeration to provide the cold reflux stream, and refrigeration to cool either (i) the purified liquefied natural gas stream or the condensed natural gas stream or (ii) both the purified liquefied natural gas stream and the condensed natural gas stream are provided by (1) warming the nitrogen-enriched overhead vapor stream from the distillation column to provide by indirect heat exchange a first portion of the refrigeration to generate the cold reflux stream and to cool either (i) the purified liquefied natural gas stream or the condensed natural gas stream or (ii) both the purified liquefied natural gas stream and the condensed natural gas stream, thereby providing a warmed nitrogen-rich vapor stream;

(2) withdrawing a first portion of the warmed nitrogen-rich vapor stream as a nitrogen reject stream and compressing a second portion of the warmed nitrogen-rich vapor stream to provide a compressed nitrogen-rich stream;

(3) combining the compressed nitrogen-rich stream with a warmed work expanded nitrogen-rich stream to provide a combined nitrogen-rich stream and compressing the combined nitrogen-rich stream to provide a combined compressed nitrogen-rich stream;

(4) cooling the combined compressed nitrogen-rich stream to yield a cooled compressed nitrogen-rich stream, work expanding a first portion of the cooled compressed nitrogen-rich stream to yield a cold nitrogen-rich refrigerant stream, and warming the cold nitrogen-rich refrigerant stream to provide by indirect heat exchange a second portion of the refrigeration to generate the cold reflux stream and to cool either (i) the purified liquefied natural gas stream or the condensed natural gas stream or (ii) both the purified liquefied natural gas stream and the condensed natural gas stream, thereby providing the warmed work expanded nitrogen-rich stream; and (5) cooling a second portion of the cooled compressed nitrogen-rich stream by indirect heat exchange with the nitrogen-enriched overhead vapor stream from the distillation column and the cold nitrogen-rich refrigerant stream to provide a cold compressed nitrogen-rich stream, and reducing the pressure of the cold compressed nitrogen-rich stream to provide the cold reflux stream.

10. The method of claim 9 wherein the purified liquefied natural gas stream is subcooled by indirect heat exchange with the nitrogen-enriched overhead vapor stream from the distillation column and the cold nitrogen-rich refrigerant stream to provide a subcooled liquefied natural gas product.

11. The method of claim 9 which further comprises reducing the pressure of the cold compressed nitrogen-rich stream to provide a cold two-phase nitrogen-rich stream, separating the cold two-phase nitrogen-rich stream to yield a cold nitrogen-rich liquid stream and a cold nitrogen-rich vapor stream, reducing the pressure of the cold nitrogen-rich liquid stream to provide the cold reflux stream, and combining the cold nitrogen-rich vapor stream with the cold nitrogen-rich refrigerant stream of (4).

12. The method of claim 11 which further comprises reducing the pressure of the cold nitrogen-rich vapor stream to provide a reduced-pressure vapor stream and combining the reduced-pressure vapor stream with either the cold nitrogen-rich refrigerant stream of (4) or the nitrogen-enriched overhead vapor stream from the distillation column of (1).

13. The method of claim 11 wherein a portion of the cold nitrogen-rich liquid stream is vaporized in an intermediate condenser in the distillation column between the first and second locations therein to form a vaporized nitrogen-rich stream, and the vaporized nitrogen-rich stream is combined with the cold nitrogen-rich vapor stream.

14. The method of claim 9 which further comprises reducing the pressure of the condensed natural gas stream to form a two-phase stream, separating the two-phase stream into a methane-enriched liquid stream and a nitrogen-enriched vapor stream, cooling the methane-enriched liquid stream by indirect heat exchange with the nitrogen-enriched overhead vapor stream from the distillation column and the cold nitrogen-rich refrigerant stream to provide a subcooled condensed natural gas feed stream, further cooling the subcooled condensed natural gas feed stream by indirect heat exchange with a vaporizing liquid withdrawn from the bottom of the distillation column to provide a vaporized bottoms stream, introducing the vaporized bottoms stream into the distillation column to provide boilup vapor therein, cooling the nitrogen-enriched vapor stream by indirect heat exchange with the nitrogen-enriched overhead vapor stream from the distillation column and the cold nitrogen-rich refrigerant stream to provide a cooled natural gas feed stream, and introducing the cooled natural gas feed stream into the distillation column at a point intermediate the first and second location therein.

15. The method of claim 14 which further comprises subcooling the purified liquefied natural gas stream by indirect heat exchange with the nitrogen-enriched overhead vapor stream from the distillation column and with the cold nitrogen-rich refrigerant stream.

16. The method of claim 9 wherein, following cooling of the second portion of the cooled compressed nitrogen-rich stream by indirect heat exchange with the nitrogen-enriched overhead vapor stream from the distillation column and the cold nitrogen-rich refrigerant stream and prior to reducing the pressure of the cold compressed nitrogen-rich stream to provide the cold reflux stream, the cold compressed nitrogen-rich stream is further cooled by indirect heat exchange with a vaporizing liquid withdrawn from the bottom of the distillation column, thereby providing a vaporized bottoms stream, and introducing the vaporized bottoms stream into the distillation column to provide boilup vapor therein.

17. The method of claim 1 wherein the cold reflux stream, refrigeration to provide the cold reflux stream, and refrigeration to cool either (i) the purified liquefied natural gas stream or the condensed natural gas stream or (ii) both the purified liquefied natural gas stream and the condensed natural gas stream are provided by (1) warming a cold nitrogen-rich vapor stream to provide a first portion of refrigeration to provide the cold reflux stream and refrigeration to cool either (i) the purified liquefied natural gas stream or the condensed natural gas stream or (ii) both the purified liquefied natural gas stream and the condensed natural gas stream, thereby providing a warmed nitrogen-rich vapor stream;

(2) compressing the warmed nitrogen-rich vapor stream to provide a compressed nitrogen-rich stream;

(3) combining the compressed nitrogen-rich stream with a warmed work expanded nitrogen-rich stream to provide a combined nitrogen-rich stream and compressing the combined nitrogen-rich stream to provide a combined compressed nitrogen-rich stream;

(4) cooling the combined compressed nitrogen-rich stream to yield a cooled compressed nitrogen-rich stream, work expanding a first portion of the cooled compressed nitrogen-rich stream to yield a cold nitrogen-rich refrigerant stream, and warming the cold nitrogen-rich refrigerant stream to provide a second portion of refrigeration to cool either (ii) the purified liquefied natural gas stream or the condensed natural gas stream or (ii) both the purified liquefied natural gas stream and the condensed natural gas stream, thereby providing the warmed work expanded nitrogen-rich stream of (3);

(f) cooling a second portion of the cooled compressed nitrogen-rich stream by indirect heat exchange with the cold nitrogen-enriched overhead vapor stream and the cold nitrogen-rich refrigerant stream to provide a cold compressed nitrogen-rich stream, and reducing the pressure of the cold compressed nitrogen-rich stream to provide a cold nitrogen-rich refrigerant stream; and (g) partially condensing overhead vapor from the distillation column in the overhead condenser by indirect heat exchange with the cold nitrogen-rich refrigerant stream to form a two-phase overhead stream and the nitrogen-rich vapor stream of (1), separating the two-phase overhead stream into a vapor portion and a liquid portion, returning the liquid portion to the distillation column as the cold reflux stream, and withdrawing the vapor portion as a nitrogen reject stream.

18. A method for the rejection of nitrogen from condensed natural gas which comprises (a) introducing a condensed natural gas feed into a distillation column at a first location therein, withdrawing a nitrogen-enriched overhead vapor stream from the distillation column, and withdrawing a purified liquefied natural gas stream from the bottom of the column; and (b) introducing a cold reflux stream into the distillation column at a second location above the first location, wherein the cold reflux stream and refrigeration to provide the cold reflux stream are obtained by steps which comprise compressing all or a portion of the nitrogen-enriched overhead vapor stream to provide a compressed nitrogen-enriched stream, work expanding a portion of the compressed nitrogen-enriched stream to generate the refrigeration to provide the cold reflux stream, and cooling and reducing the pressure of another portion of the compressed nitrogen-enriched stream to provide the cold reflux stream.

19. The method of claim 18 wherein the condensed natural gas feed to the distillation column is provided by cooling condensed natural gas by indirect heat exchange with a vaporizing liquid withdrawn from the bottom of the distillation column to provide a vaporized bottoms stream, and introducing the vaporized bottoms stream into the distillation column to provide boilup vapor therein.

20. The method of claim 18 wherein the cold reflux stream and refrigeration to provide the cold reflux stream are provided by (a) warming the nitrogen-enriched overhead vapor stream from the distillation column to provide a first portion of refrigeration to provide the cold reflux stream, thereby providing a warmed nitrogen-rich vapor stream;

(b) withdrawing a first portion of the warmed nitrogen-rich vapor stream as a nitrogen reject stream and compressing a second portion of the warmed nitrogen-rich vapor stream to provide a compressed nitrogen-rich stream;

(c) combining the compressed nitrogen-rich stream with a warmed work expanded nitrogen-rich stream to provide a combined nitrogen-rich stream and compressing the combined nitrogen-rich stream to provide a combined compressed nitrogen-rich stream;

(d) cooling the combined compressed nitrogen-rich stream to yield a cooled compressed nitrogen-rich stream, work expanding a first portion of the cooled compressed nitrogen-rich stream to yield a cold nitrogen-rich refrigerant stream, and warming the cold nitrogen-rich refrigerant stream to provide a second portion of the refrigeration to provide the cold reflux stream, thereby providing the warmed work expanded nitrogen-rich stream; and (e) cooling a second portion of the cooled compressed nitrogen-rich stream by indirect heat exchange with the nitrogen-enriched overhead vapor stream from the distillation column and the cold nitrogen-rich refrigerant stream to provide a cold compressed nitrogen-rich stream, reducing the pressure of the cold compressed nitrogen-rich stream to provide a reduced-pressure cold nitrogen-rich stream, and introducing the reduced-pressure cold nitrogen-rich stream into the distillation column as the cold reflux stream.

21. The method of claim 18 which further comprises reducing the pressure of the condensed natural gas prior to the distillation column by passing the cooled liquefied natural gas feed through a dense-fluid expander.

22. A system for the rejection of nitrogen from condensed natural gas which comprises (a) a distillation column having a first location for introducing the condensed natural gas, a second location for introducing a cold reflux stream, wherein the second location is above the first location, an overhead line for withdrawing a nitrogen-enriched overhead vapor stream from the top of the column, and a line for withdrawing a purified liquefied natural gas stream from the bottom of the column;

(b) compression means for compressing a refrigerant comprising nitrogen to provide a compressed nitrogen-containing refrigerant;

(c) an expander for work expanding a first portion of the compressed nitrogen-containing refrigerant to provide a cold work-expanded refrigerant;

(d) heat exchange means for warming the cold work-expanded refrigerant and for cooling, by indirect heat exchange with the cold work-expanded refrigerant, a second portion of the compressed nitrogen-containing refrigerant and either (1) the purified liquefied natural gas stream or the condensed natural gas stream or (2) both the purified liquefied natural gas stream and the condensed natural gas stream; and (e) means for reducing the pressure of a cooled second portion of the compressed nitrogen-containing refrigerant withdrawn from the heat exchange means to provide refrigeration to the distillation column.

23. The system of claim 22 which comprises piping means to combine the nitrogen-enriched overhead vapor stream and the cold work-expanded nitrogen-rich gas to form a cold combined nitrogen-rich stream, and wherein the heat exchange means comprises one or more flow passages for warming the cold combined nitrogen-rich stream to provide a warmed combined nitrogen-rich stream.

24. The system of claim 23 wherein the compression means includes a single-stage compressor for compression of the warmed combined nitrogen-rich stream.

25. The system of claim 22 wherein the heat exchange means comprises a first group of flow passages for warming the nitrogen-enriched overhead vapor stream to form a warmed nitrogen-enriched overhead vapor stream and a second group of flow passages for warming the cold work-expanded refrigerant to form a warmed work-expanded refrigerant.

26. The system of claim 25 wherein the compression means includes a compressor having a first stage and a second stage, and wherein the system includes piping means to transfer the warmed nitrogen-enriched overhead vapor stream from the heat exchange means to an inlet of the first stage of the compressor and piping means to transfer the warmed work-expanded refrigerant from the heat exchange means to an inlet of the second stage of the compressor.

27. A system for the rejection of nitrogen from condensed natural gas which comprises (a) a distillation column having a first location for introducing the condensed natural gas into the distillation column, a second location for introducing a cold reflux stream into the distillation column, wherein the second location is above the first location, an overhead line for withdrawing a nitrogen-enriched overhead vapor stream from the distillation column, and a line for withdrawing a purified liquefied natural gas stream from the bottom of the column;

(b) compression means for compressing all or a portion of the nitrogen-enriched overhead vapor stream to provide a compressed nitrogen-rich vapor stream;

(c) an expander for work expanding a first cooled compressed nitrogen-rich vapor stream to provide a cold work-expanded nitrogen-rich stream;

(d) heat exchange means comprising (d1) a first group of flow passages for warming the cold work-expanded nitrogen-rich stream to provide a warm work-expanded nitrogen-rich stream;

(d2) a second group of flow passages for warming the nitrogen-enriched overhead vapor stream from the distillation column to provide a warm nitrogen-enriched overhead vapor stream;

(d3) a third group of flow passages for cooling the compressed nitrogen-rich vapor stream by indirect heat exchange with the cold work-expanded nitrogen-rich stream and the nitrogen-enriched overhead vapor stream from the distillation column to provide the first cooled compressed nitrogen-rich vapor stream and a second cooled compressed nitrogen-rich vapor stream; and (e) means for reducing the pressure of the second cooled compressed nitrogen-rich vapor stream to provide the cold reflux stream and means for introducing the cold reflux stream into the distillation column at the second location.

28. The system of claim 27 which further comprises reboiler means for cooling the condensed natural gas prior to introduction into the distillation column by indirect heat exchange with a vaporizing stream withdrawn from the bottom of the distillation column, thereby forming a vaporized stream, and means to introduce the vaporized stream into the bottom of the distillation column to provide boilup vapor therein.

29. The system of claim 27 wherein the compression means includes a compressor having a first stage and a second stage, and wherein the system includes piping means to transfer the warm nitrogen-enriched overhead vapor stream from the heat exchange means to an inlet of the first stage of the compressor and piping means to transfer the warm work-expanded nitrogen-rich stream from the heat exchange means to an inlet of the second stage of the compressor.

* * * * *